US010393438B2

(12) United States Patent
MacRae

(10) Patent No.: US 10,393,438 B2
(45) Date of Patent: Aug. 27, 2019

(54) CANTILEVERED COOLER SHELF FOR REFRACTORY BRICK FURNACES

(71) Applicant: Allan J. MacRae, Hayward, CA (US)

(72) Inventor: Allan J. MacRae, Hayward, CA (US)

(73) Assignee: MacRae Technologies, Inc., Hayward, CA (US)

( * ) Notice: Subject to any disclaimer, the term of this patent is extended or adjusted under 35 U.S.C. 154(b) by 0 days.

(21) Appl. No.: 16/174,714

(22) Filed: Oct. 30, 2018

(65) Prior Publication Data

US 2019/0063839 A1 Feb. 28, 2019

(51) Int. Cl.
*F27D 1/12* (2006.01)
*F27D 9/00* (2006.01)

(52) U.S. Cl.
CPC ..... *F27D 1/12* (2013.01)

(58) Field of Classification Search
CPC ..... F27D 1/12; F27D 9/00
USPC ..... 266/46, 109, 190–194, 241, 270
See application file for complete search history.

(56) References Cited

U.S. PATENT DOCUMENTS

2018/0003440 A1* 1/2018 MacRae ..... F27D 1/004

* cited by examiner

*Primary Examiner* — Lois L Zheng
(74) *Attorney, Agent, or Firm* — Main Law Cafe

(57) ABSTRACT

At least one row of fixed copper coolers are arranged in a furnace in a cantilevered horizontal shelf inside and fastened to an external steel ring support and the steel containment shell. These shelves redirect and take all the weight of refractory brick and floating cooling blocks that are stacked on above. Each fixed copper cooler in the shelves cantilever shoulder-to-shoulder over any refractory brick and floating cooling blocks that may be stacked beneath to relieve that lower portion of the wall from the weight of the upper wall. When relieved of such weight, the risks of sudden catastrophic failure of the lower walls is reduced. These bricks in the lower walls can also be allowed to wear and thin beyond what would be reasonable in a conventional design without any cantilevered shelving.

10 Claims, 11 Drawing Sheets

CANTILEVERED COOLER SHELF FOR REFRACTORY BRICK FURNACES

FIELD OF INVENTION

The present invention relates to smelting furnaces with walls of refractory brick and copper coolers that line the inside walls of their steel containment shells. And more specifically, to improving the campaign lives of such furnaces by relieving a lowest base tier of refractory-brick wall of weight they conventionally bear from above in supporting the upper tiers refractory-brick wall. A modular, liquid-cooled cantilever support shelf is fixed just above the lowest base tier to the steel containment shells. The cantilever support shelf then bears all the weight of the upper tiers of refractory brick walls.

BACKGROUND

AUSMELT®/ISASMELT™ non-ferrous smelters drop moist solid feeds from above into a tall cylindrical furnace with a matte/metal/slag bath while also blowing oxygen-enriched air down in through a submerged vertical lance. (AUSMELT® of Outotec, and ISASMELT™ of Glencore Technology.) Once fully melted, the matte/slag is periodically tapped into another furnace for separation. These are often referred to as Top Submerged Lance (TSL) furnaces.

The AUSMELT top submerged lance technology optimizes feed material dissolution, energy transfer, reaction, primary combustion, and other critical processes which all take place in the slag layer inside the smelter vessel. Submerging the gas injection ensures that reactions occur rapidly and residence times will be low due to an intense agitation that is caused in the vessel. The degree of oxidation and reduction can be controlled by adjusting the fuel:oxygen ratio supplied to the lance, and the proportion of reductant coal to feed. This easy way to control the oxidation and reduction enables the furnace to be selectively operated between strongly oxidizing through strongly reducing conditions. Operating temperatures in AUSMELT top submerged lance furnaces can range from 900° C. to 1400° C.

ISASMELT furnaces are top-entry submerged-lance upright-cylindrical shaped steel vessels that are lined with refractory bricks. Inside at the bottom of the furnace, in the "liquid zone", is a molten bath of slag, matte, or metal. A hollow steel lance is lowered into the bath through a hole in the roof of the furnace, and air or oxygen-enriched air is forcefully injected through the lance to agitate the bath.

Mineral concentrates and other materials are dropped into the bath from above through a hole in the roof. If suitably fine, such materials can also be injected down the lance with the air. An intense reaction results in a small volume when the feed materials contact, heat, and react with the oxygen in the injected gas.

Lances may include "swirlers" that force the injected gas to vortex against the walls inside to more effectively cool the lance's walls. Outside of the lance, a layer of slag will freeze on the air-cooled walls. Such frozen slag helps isolate the steel lance from the surrounding temperatures which could be high enough to melt the lance if contacted directly. But ultimately the steel tip of all submerged lances will wear out from the immediately surrounding violence and need replacement. The good news is worn lances are easily refurbished and replaced. The worn tips are simply cut off and new tips are welded onto the original lance body.

ISASMELT furnaces typically operate in the range of 1000-1200° C., depending on their application. The refractory bricks that line the inside floors and walls of the furnaces are there to protect the steel shell from the severe heat inside the furnace that would otherwise quickly melt the steel shell.

Refractory bricks are subject to corrosion, wear, uneven heating, swelling with ingrained melt, and fractures because they are brittle. But the refractory bricks in the liquid bath zone of a furnace are especially subject to corrosion and thinning. So as they corrode and thin, they are less able to support the weight of refractory brick wall lining above. (Conventional practice has been to direct the entire weight of the complete refractory brick wall lining vertically down to its ring footing.) Embodiments of the present invention divide the weight amongst one or more upper tiers each fitted with cantilevered shelves.

Smelted products are removed from furnaces through tap holes in a procedure called "tapping". Such tapping can be continuous, or done in batches. At the end of a tap, the tap holes can be closed by blocking them with clay plugs. They can be reopened by thermic lances and/or by drilling. Alternatively, the melt can be removed from the furnace using either an underflow or an overflow weir for continuous discharge of molten material.

The smelted products thus tapped will separate on their own once they arrive and settle in a rotary holding furnace, an electric furnace, a settling vessel, a melt-transporting ladle, or granulated.

Most of the large amount of energy needed for smelting that is used to heat and melt sulfide concentrates and feed materials is a product of the reaction of oxygen with sulfur and iron in the concentrates. A small amount of supplemental energy that is needed to balance out losses is supplied by injecting coal, coke, petroleum coke, oil, or natural gas to react with the injected air. Solid fuels are best added through the top of the furnace along with the feed materials, and liquid and gas fuels can be injected with the air forced down inside the lance.

Eventually all furnaces reach the ends of their campaign lives. Such ends-of-life are preferably planned for and expected, rather than catastrophic, as can occur with a refractory-brick wall collapse.

The furnaces we are concerned with here stack refractory-brick in walls that are not fixed to the inner walls of the steel vessels. The bricks in these walls wear differently due to variances in abrasion, corrosion, and other factors that occur below the bath level and above the bath level.

Conventional furnaces of this type stacked all the refractory-brick in the walls in one uninterrupted pile. Some include floating cooling blocks in these stacks that moved with the brick under thermal expansion forces. Each row of brick and floating cooling blocks has to support the weight of every row above it and pass that weight down until the burden reaches the furnace floor.

The portion of refractory-brick walls at the bottom around the bath zone has to bear the most weight and is subject to severe wear.

SUMMARY

Briefly, furnace embodiments of the present invention include at least one row of fixed copper coolers arranged in a cantilevered horizontal shelf inside. These are fastened to an external steel ring support through fenestrations in the steel containment shell. These shelves take all the weight of refractory brick and floating cooling blocks stacked on them and redirect the weight into the steel containment shell. Each fixed copper cooler in the shelves hangs shoulder-to-shoulder to cantilever over any refractory brick and floating cooling blocks stacked beneath. The lower portion of the wall is thus relieved of the weight of the upper wall. When relieved of such weight, the risks of sudden catastrophic failure of the lower walls are reduced. These bricks in the lower walls can also be allowed to wear and thin beyond what would be reasonable in a conventional design without any cantilevered shelving.

SUMMARY OF THE DRAWINGS

FIG. 1A represents a situation in which the fixed cantilevered copper cooler shelf is immediately above bathline copper coolers. FIG. 1B represents an alternative situation in which the fixed cantilevered copper cooler shelf is higher up in the furnace with stacks of refractory brick and copper coolers beneath;

FIG. 3A is an isometric projection diagram of an AUSMELT furnace embodiment of the present invention that is unusual in that it includes a splash block. Splash blocks are more normally included in ISASMELT furnaces. Here, the splash block copper cooler is obscured in this illustration, but can be better understood from FIG. 6;

FIGS. 3B and 3C are close ups of FIG. 3A in side view diagrams of the horizontal cantilever copper coolers typical of vertically orientated metal smelting furnace embodiments of the present invention. In particular are shown the details of the mechanical fastening and fixing of the individual cantilever copper coolers externally through shell cutouts or fenestrations to a steel horizontal support ring of the shell with large machine bolts;

FIG. 3D is a side view diagram of a single horizontal cantilever copper cooler bolted in place onto the external support ring of the steel containment shell;

FIG. 3E is a view diagram of the single horizontal cantilever copper cooler of FIG. 3D bolted in place onto the external support ring of the steel containment shell. The main body of the copper cooler stays inside the steel containment shell and fingered foot-mounting bosses are passed through fenestrations so they can be fastened as shown;

FIG. 3E is a perspective view diagram of the single horizontal cantilever copper cooler of FIGS. 3D and 3E bolted in place onto the external support ring of the steel containment shell. However, the steel containment shell is not shown;

FIG. 7A shows its position in the furnace necessary to keep and avert a collapse of a brick wall otherwise normally supported by individual cantilevered copper coolers arranged in horizontal shelf.

DETAILED DESCRIPTION OF THE EMBODIMENTS

Shelves of fixed cantilevered copper coolers in embodiments of the present invention provide full support of the weight of walls of brick and floating cooling blocks stacked in rows and ringed around just inside the steel containment shells of furnaces. Some furnace applications will require two or more such shelves of fixed cantilevered copper coolers and brick.

Any vertical copper coolers or rings of cooling blocks lower in the furnace and situated below a shelf ring of fixed cantilever copper coolers will be independently supported from below. Any rings of copper coolers positioned below a fixed cantilever copper cooler can have brick, castable, rammix, plastic refractory, or no refractory facings. Hard facings welded on them would also be appropriate.

Our fixed cantilever copper coolers partition tall refractory linings into shorter independent stacks and thereby eliminate conventional problems with differential thermal expansion. These shelves of fixed cantilever copper coolers reduce the risks of sudden failure where only brick is placed below. Such lower brick can suffer severe local wear and may buckle and fail if it must bear the weight of brick above. So the shelves of fixed cantilever copper coolers take the weight and vertical pressure off the high wear lower brick, and reduce the possibility of sudden brick lining wall collapse.

Brick supported this way with one or more shelf rings of fixed cantilevered copper coolers, makes it practical to rebuild only the highly worn parts of the refractory. Without such intermediary support, replacing the lower brick would mean all of the brick not anchored to the shell above would have to be replaced as well every time.

Figure 1A:
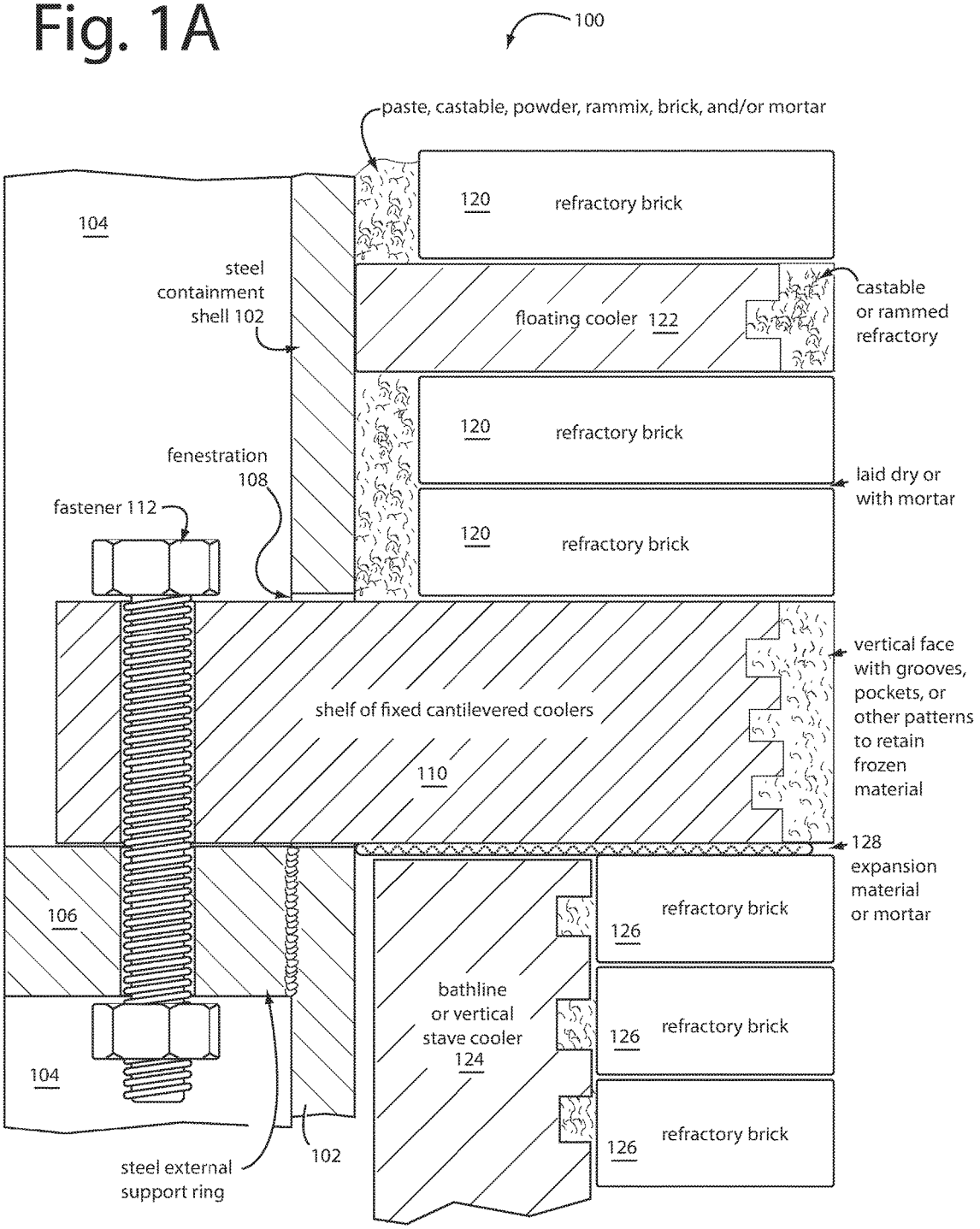
FIGS. 1A and 1B are close-in cross sectional views of the joint in a brick lined furnace between a fixed cantilevered copper cooler shelf and its fastening through fenestrations in the steel containment shell to an external support ring.

FIG. 1A includes a portion of a vertically orientated metal smelting or converting furnace 100 in which at least a part of its steel shelled vessel is cylindrical. A steel containment shell 102 is externally reinforced and braced by welded on vertical ribs 104 and steel external support rings 106. Horizontal rows of fenestrations 108 just above the steel external support rings 106 allow individual cantilevered copper coolers arranged on a horizontal shelf 110 to be inserted from inside and bolted down. Here heavy fasteners 112 are used to bolt down two each fingered projections of the individual cantilevered copper coolers that pass through fenestrations 108. These then can support a lot of weight inside above on the shelf 110.

Each individual cantilevered copper cooler arranged in horizontal shelf 110 is typically made of cast copper. And as such, the copper hot face must be protected from wear, abrasion, and corrosion by slag, matte or other frozen material that is assisted in adhering by grooves, pockets, or other textured patterns in the vertical face.

Furnace 100 is fully lined inside with walls of refractory brick 120 stacked dry or mortared to one another. These are set with paste, castable, powder, rammix, brick, and/or mortar up against steel containment shell 102. Some installations will include floating cooling blocks 122. And these can be faced with castable or rammed refractory to protect their hot face from wear. Areas which could be exposed to wear or oxidation may be protected with a weld overlay or other hardfacing.

Hardfacings like weld overlays applied to copper cooling blocks will increase their wear resistance, and thus increase the campaign life of the furnace. Wear results from abrasion, impacts, metal-to-metal contacts, heat, and corrosion of the hot face surface. I prefer here hardfacings that comprise at least one alloy of nickel and chromium which fused by welding. Such is applied to less than the entire surface, and only on those portions of the surface of the hot face predetermined to be more exposed during use to wear than are any other portions.

These hardfacings are applied as a weld overlay of molten metal in an inert shield gas. One useful material that will produce good results is any alloy between nickel and chromium that has a minimum of 55% nickel, a minimum of 18% chromium, and a maximum of 6% iron.

FIG. 1A represents the situation in which the individual cantilevered copper coolers are arranged in a horizontal shelf 110 just above the furnace bath zone. Below, bathline or vertical stave copper coolers 124 will be used with more refractory brick 126. The top of this stack, just under the individual cantilevered copper coolers arranged in a horizontal shelf 110, is sealed with an expansion material or mortar 128. Such bears no weight from above because the individual cantilevered copper coolers are arranged in horizontal shelf 110 diverts all its weight and the weight of bricks 120 and floating cooling blocks 122 out onto steel external support ring 106 and then into steel containment shell 102.

Figure 1B:
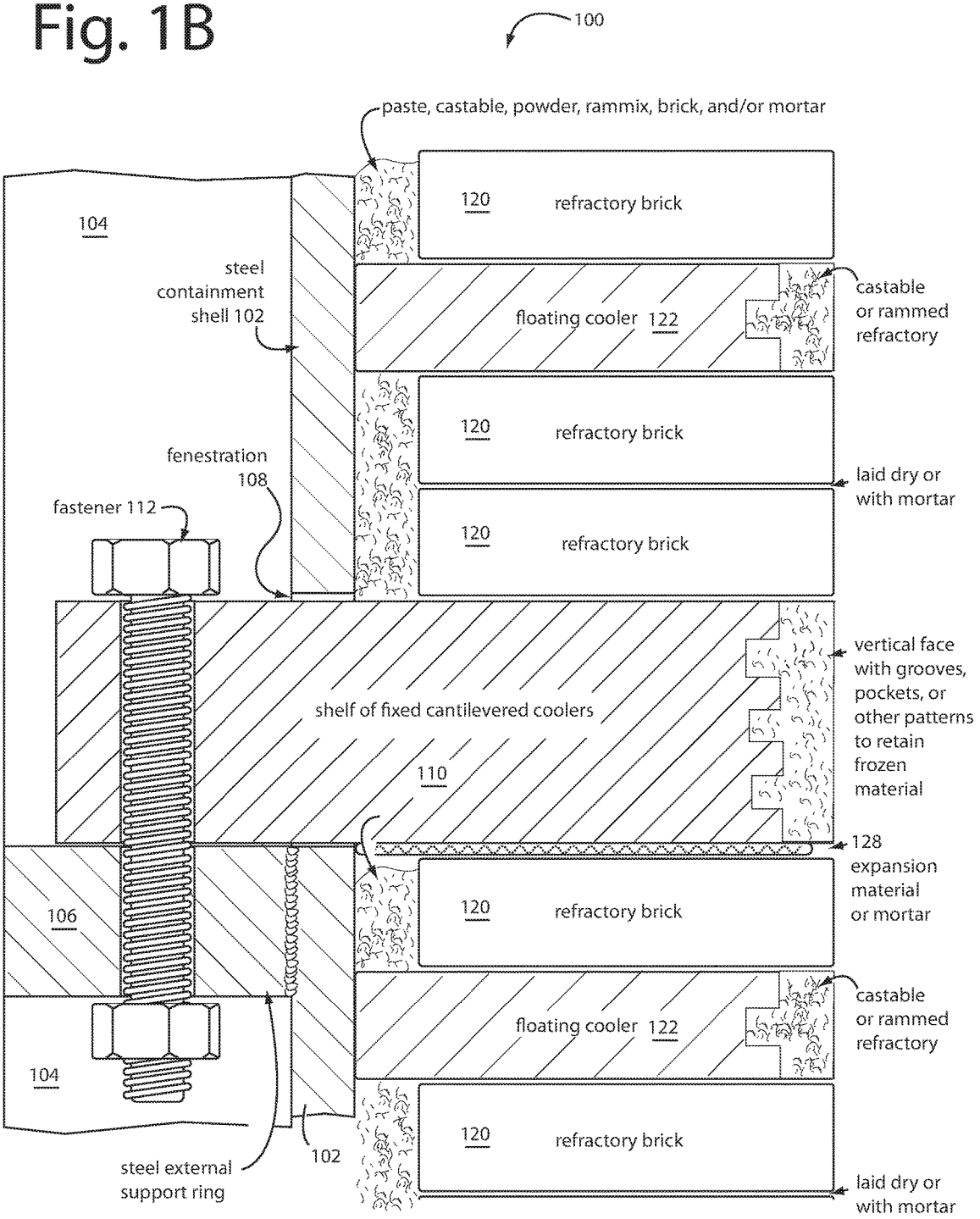

FIG. 1B represents an alternative situation in which the individual cantilevered copper coolers are arranged in a horizontal shelf 110 above another wall of stacked refractory bricks 120 and floating cooling blocks 122. As in a second tier. The top of this stack too, just under the individual cantilevered copper coolers arranged in horizontal shelf 110 is sealed with an expansion material or mortar 128. Such again bears no weight from above because the individual cantilevered copper coolers arranged in horizontal shelf 110 will divert all its weight and the weight of the upper refractory bricks 120 and floating cooling blocks 122 out into steel external support ring 106 and then onto steel containment shell 102.

Figure 7B:
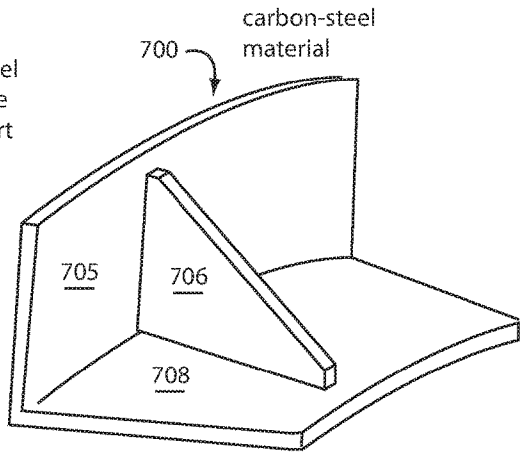
FIGS. 7A and 7B are an in-situ cross sectional view diagram and a perspective view diagram of a steel failsafe shelf support hanger.
Figure 7A:
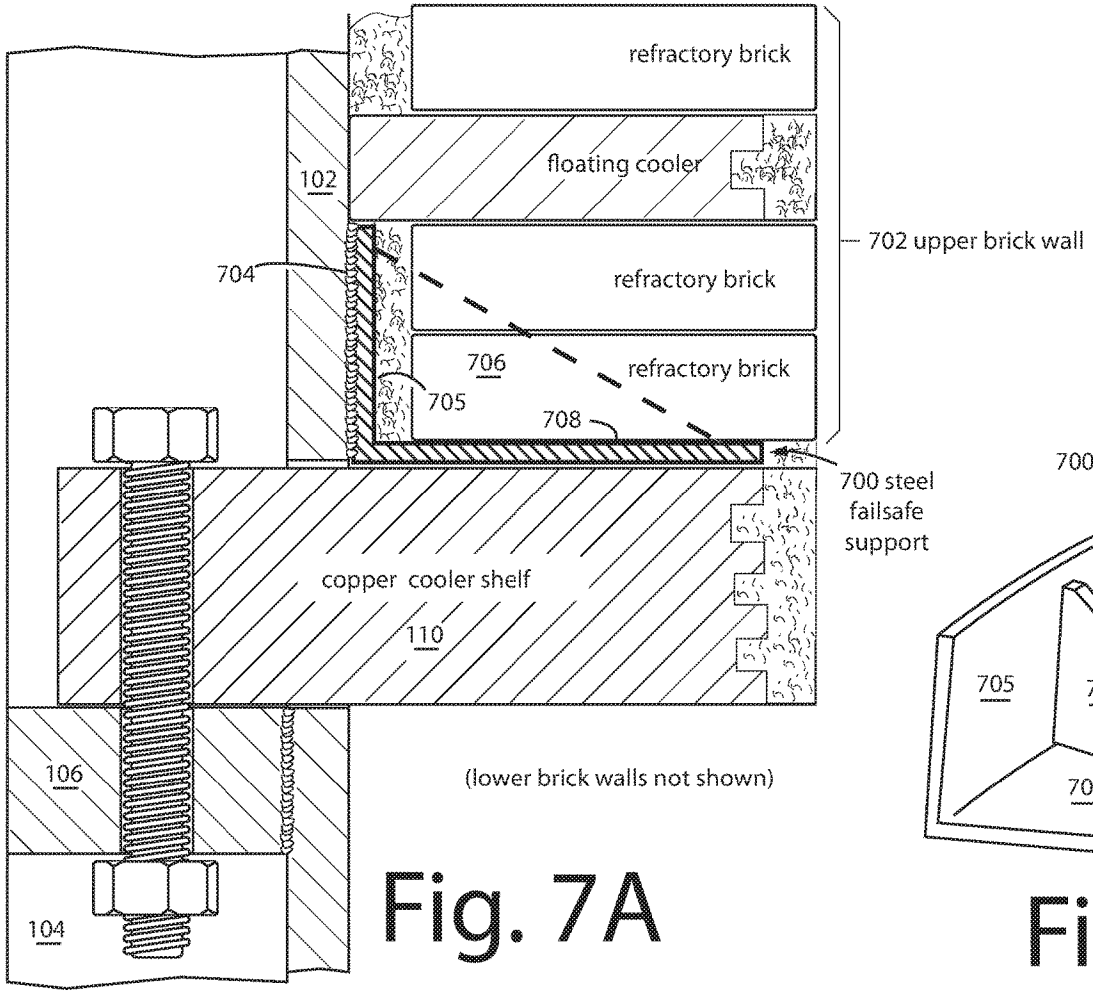

A complete loss of cooling in the individual cantilevered copper coolers arranged in horizontal shelf 110 would subject the brick walls they support above to sudden collapse if the copper gets hot enough to melt. A steel failsafe support that would catch and prevent such a collapse is illustrated in FIG. 7 and discussed below.

Figure 2:
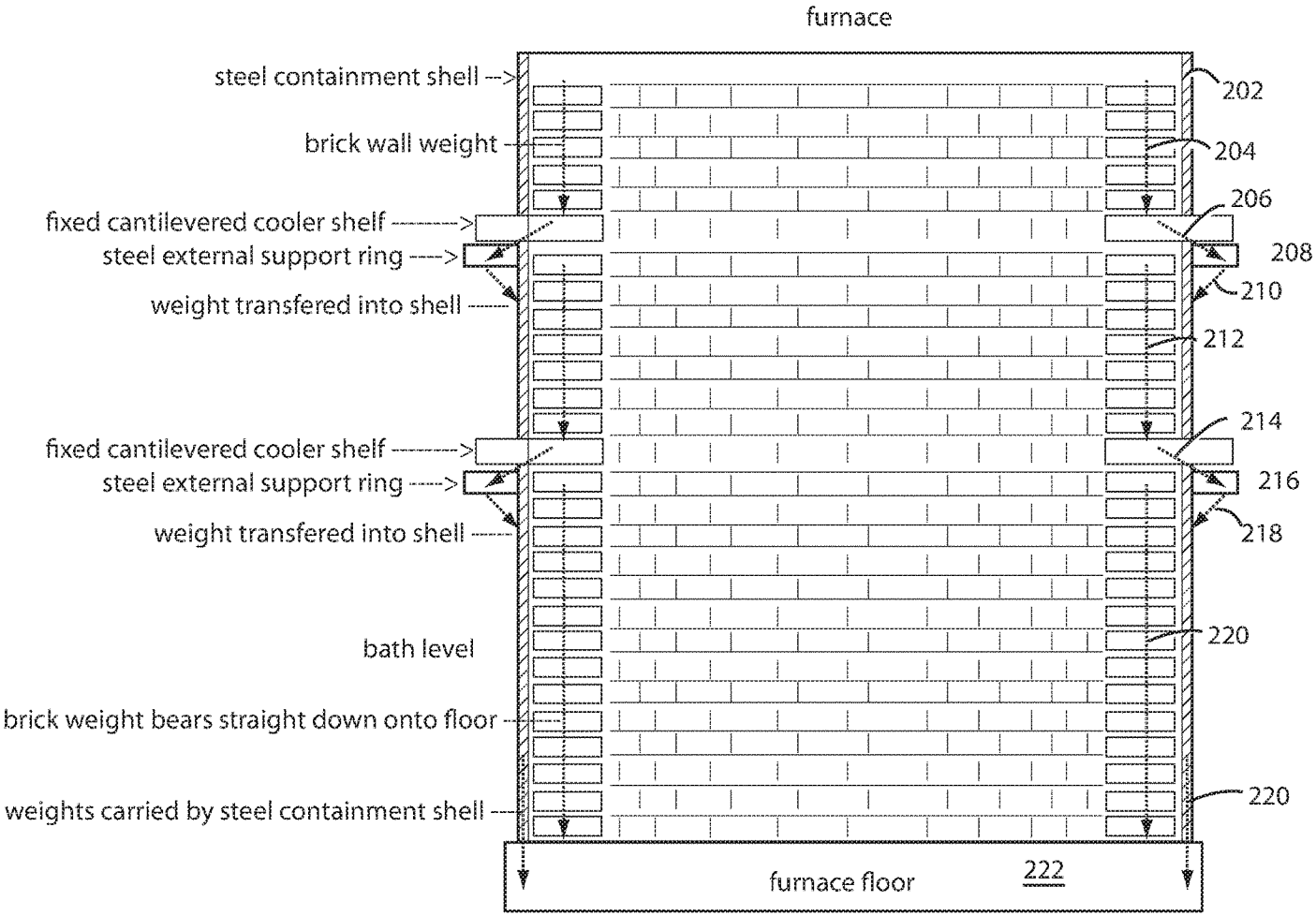
FIG. 2 is a cross sectional diagram view of the furnace shown only in part in FIGS. 1A and 1B. It illustrates how each fixed cantilevered copper cooler shelf takes and redirects the weight they carry into the containment shell.

FIG. 2 is intended to show how the weight of refractory brick in any upper tier is diverted by the individual cantilevered copper coolers arranged in horizontal shelves. A furnace 200 has a steel containment shell 202 fenestrated in two horizontal rows. Each row of fenestrations allows an upper partition weight 204 of an upper tier of bricks and floating cooling blocks to transfer through a fixed cantilevered shelf 206 outside to a steel external support ring 208. All the weight is diverted 210 into the steel containment shell.

The lower row of fenestrations allows a middle partition weight 212 of middle tier of bricks and floating cooling blocks to transfer through a fixed cantilevered shelf 214 outside to a steel external support ring 216. All this weight too is diverted 218 into the steel containment shell.

A bottom partition weight 220 of bricks and copper coolers, especially in the liquid bath area bears directly down onto a furnace floor 222. Such bricks and copper coolers are thus not burdened with the substantial weight of partitions 204 and 212 above.

This leads to a major advantage of embodiments of the present invention in that the bottom section of refractory brick lining in the bath zone can be allowed to corrode and thin beyond conventional minimums because it doesn't have to support all the weight above. Thus extending the useful campaign life and even increasing the bath volume.

The refractory brick in the lower partition contains a liquid bath of slag, matte, and/or metal. Such liquid bath is highly corrosive to refractory brick and will thin the brick over time. Such thinning will eventually compromise the ability of the refractory brick lining to support the weight of more elevated sections of refractory brick lining.

Over the campaign life of furnaces like furnaces 100 (FIGS. 1A and 1B) and 200 (FIG. 2), there will be a gradual upward expansion and growth of the refractory brick linings in each of the partitions. Such growth is fully separated by one or more cantilever shelves of copper coolers.

The thermal expansion and growth of the refractory brick linings creates challenges in keeping the areas just under each cantilever shelf of copper coolers sealed. Hot process gases must not be allowed to find and escape through cracks and fractures in the refractory. So any seals must accommodate the expansion and growth of the refractory brick linings.

Embodiments of the present therefore include at least a vertical slip joint or a compressible refractory material to seal the areas just under the cantilever shelf of copper coolers.

FIGS. 3A-3F represent an improved AUSMELT furnace 300 with a steel containment shell 302 in an embodiment of the present invention. These furnaces are improved to separate and fully support a refractory brick lining above a bath zone with at least one horizontal copper cooler cantilever shelf 308 fixed externally to a cylindrical steel vessel. The cantilever shelf 308 is detailed more fully by FIG. 4 with a plan view, e.g., ring row of cantilever copper coolers 400. A second horizontal copper cooler cantilever shelf 210 is also independently fixed externally to the cylindrical steel vessel 208. The second horizontal copper cooler cantilever shelf 210 may include a splash block 212 and is detailed more fully by FIG. 6 with a plan view, e.g., ring row of cantilever copper coolers 600.

Figure 4:
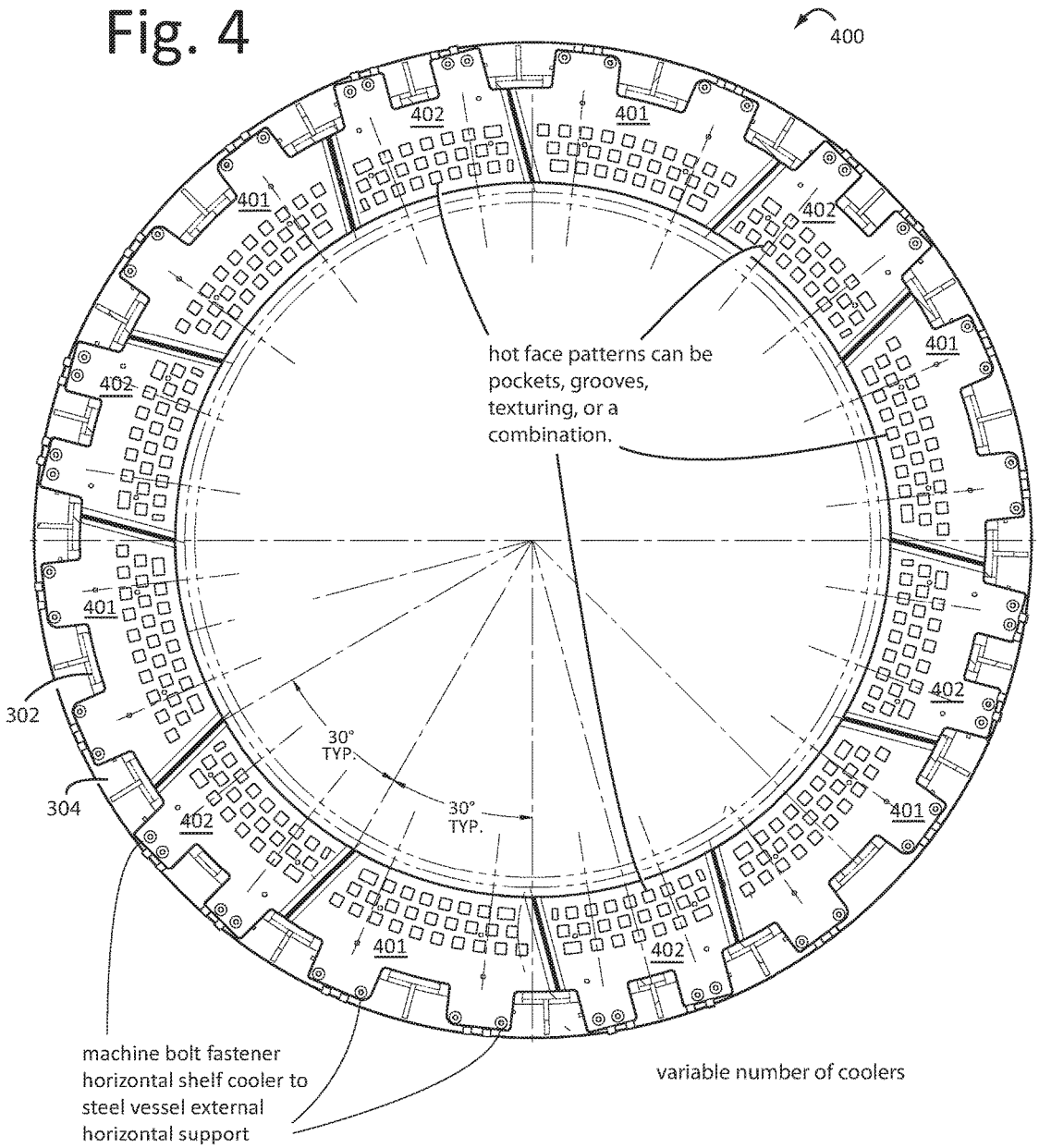
FIG. 4 is a plan view diagram of a ring row of cantilever copper coolers as included in the vertically orientated metal smelting or converting furnace embodiments of the present invention above.

This second horizontal copper cooler cantilever shelf 210 need not necessarily include splash block 212. In such case, the second horizontal copper cooler cantilever shelf 210 could be identical to the first horizontal copper cooler cantilever shelf 206 as shown in FIG. 4.

The benefit in bolting both the first and second horizontal copper cooler cantilever shelves 206 and 210 with fasteners to the cylindrical steel vessel 208 is their respective weight loads can be fully redirected into the steel vessel 208, and off the refractory brick in bath zone 204. The cylindrical steel vessel 208 is therefore conscripted to carry all such weight. The more elevated refractory brick lining and horizontal copper coolers 214 and 216 are allowed to float because they will expand vertically upwards as the refractory material swells over the campaign life.

An external, horizontal steel ring rib 220 is an important structural component of the cylindrical steel vessel 208. Such provides a strong ledge on which machine bolts can be used to secure the individual copper coolers of the first horizontal copper cooler cantilever shelf 206. FIG. 4 shows cantilever shelf 206 in more detail with a plan view.

Figure 6:
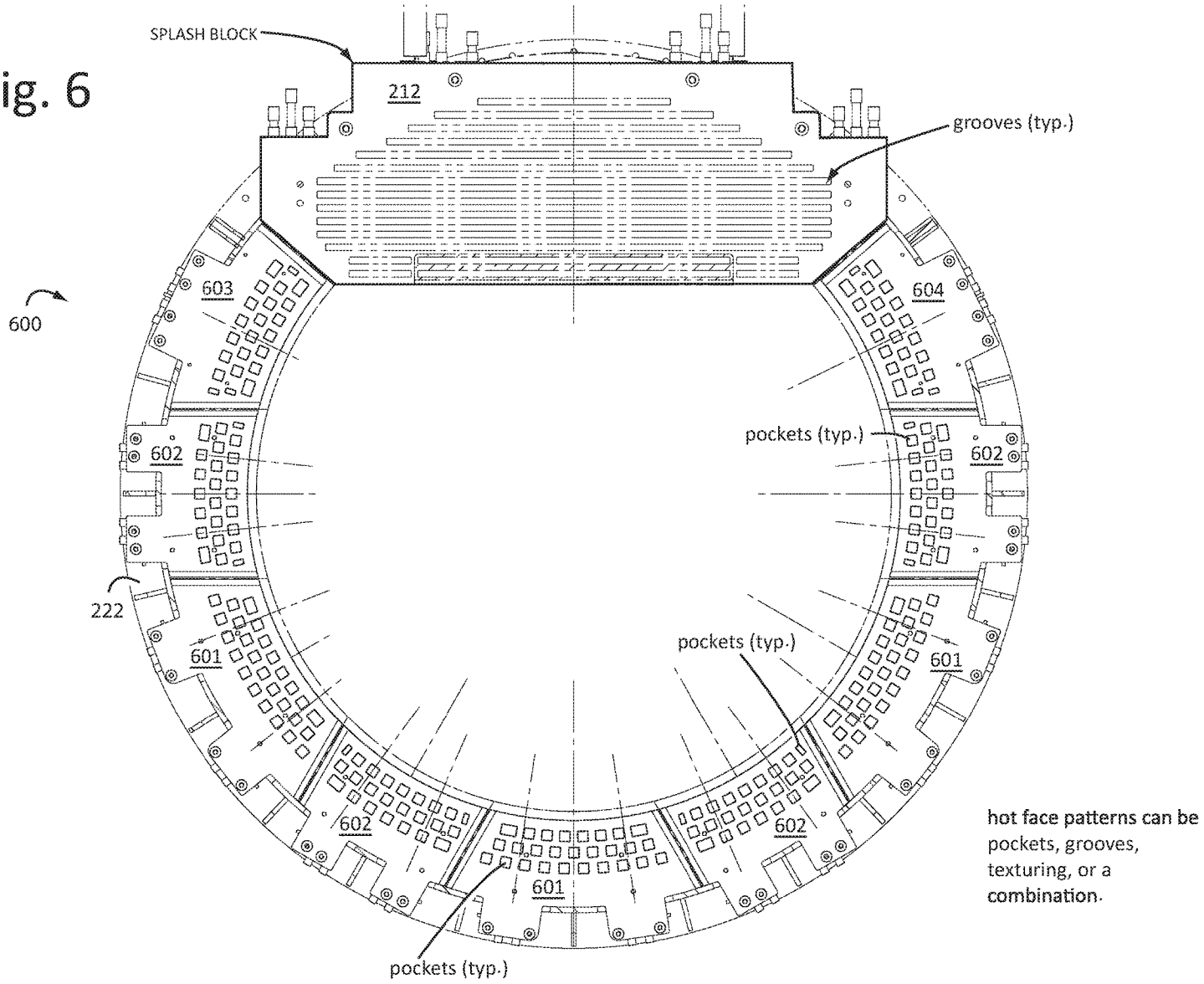
FIG. 6 is a plan view diagram of a ringed row of cantilever copper coolers with a splash block as included in the vertically orientated metal smelting or converting furnace embodiments of the present invention as in FIGS. 3A-3F.

Another external, horizontal steel ring rib 222, higher above, is one more essential structural component of cylindrical steel vessel 208. This too provides a second strong ledge on which machine bolts can be used to secure the individual copper coolers of the second horizontal copper cooler cantilever shelf 210. FIG. 6 shows cantilever shelf 210 in more detail with a plan view. Such mounting details are better illustrated in FIGS. 3A and 3B.

Figures 3A, 3B:
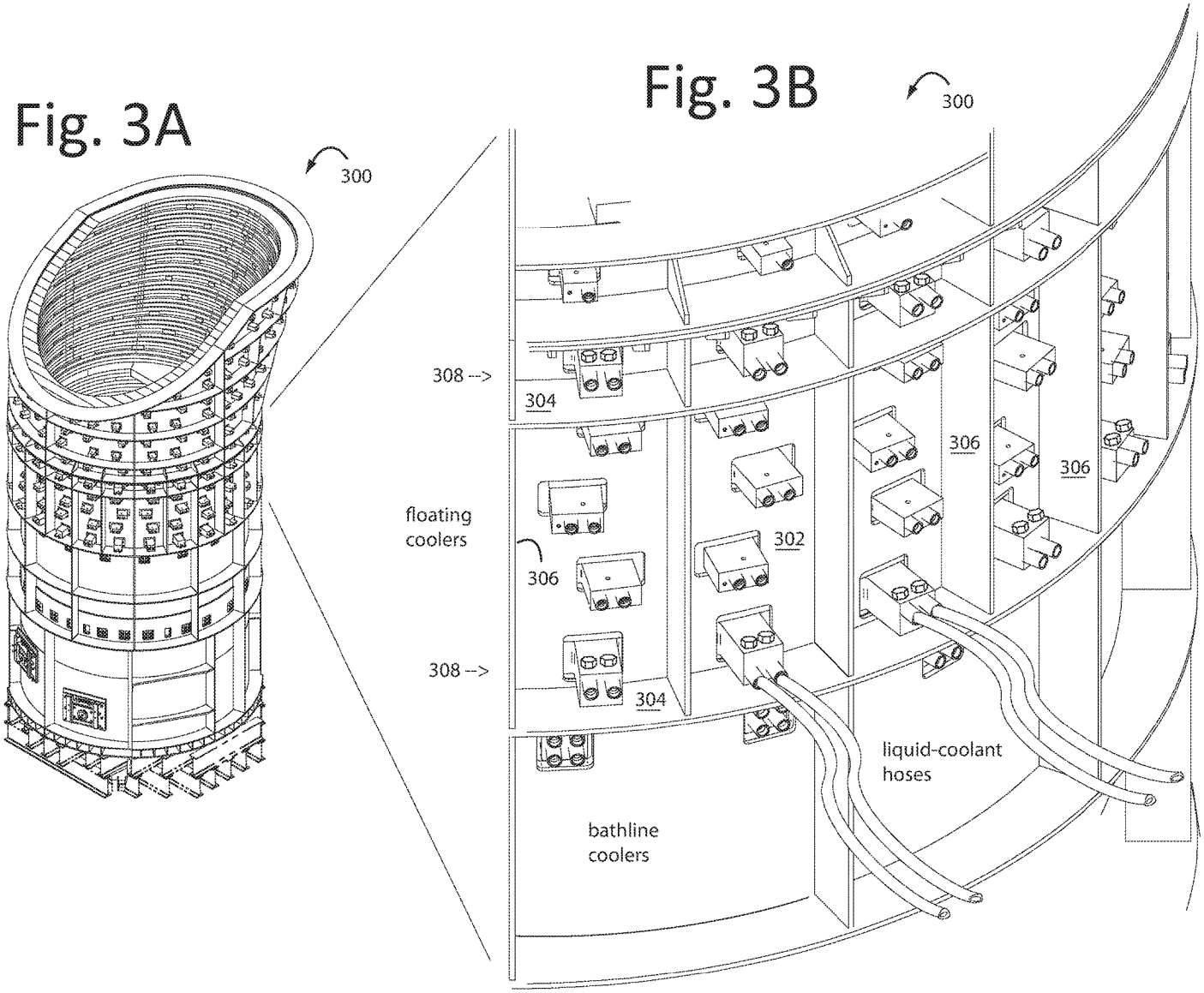
FIGS. 3A-3F are a series of perspective diagrams of a furnace built with the fixed cantilever copper coolers of FIGS. 1A and 1B arranged in two horizontal rows. The series is intended to show in closer and closer views how the fixed cantilever copper coolers are fixed to the steel containment shell.
Figure 3C:
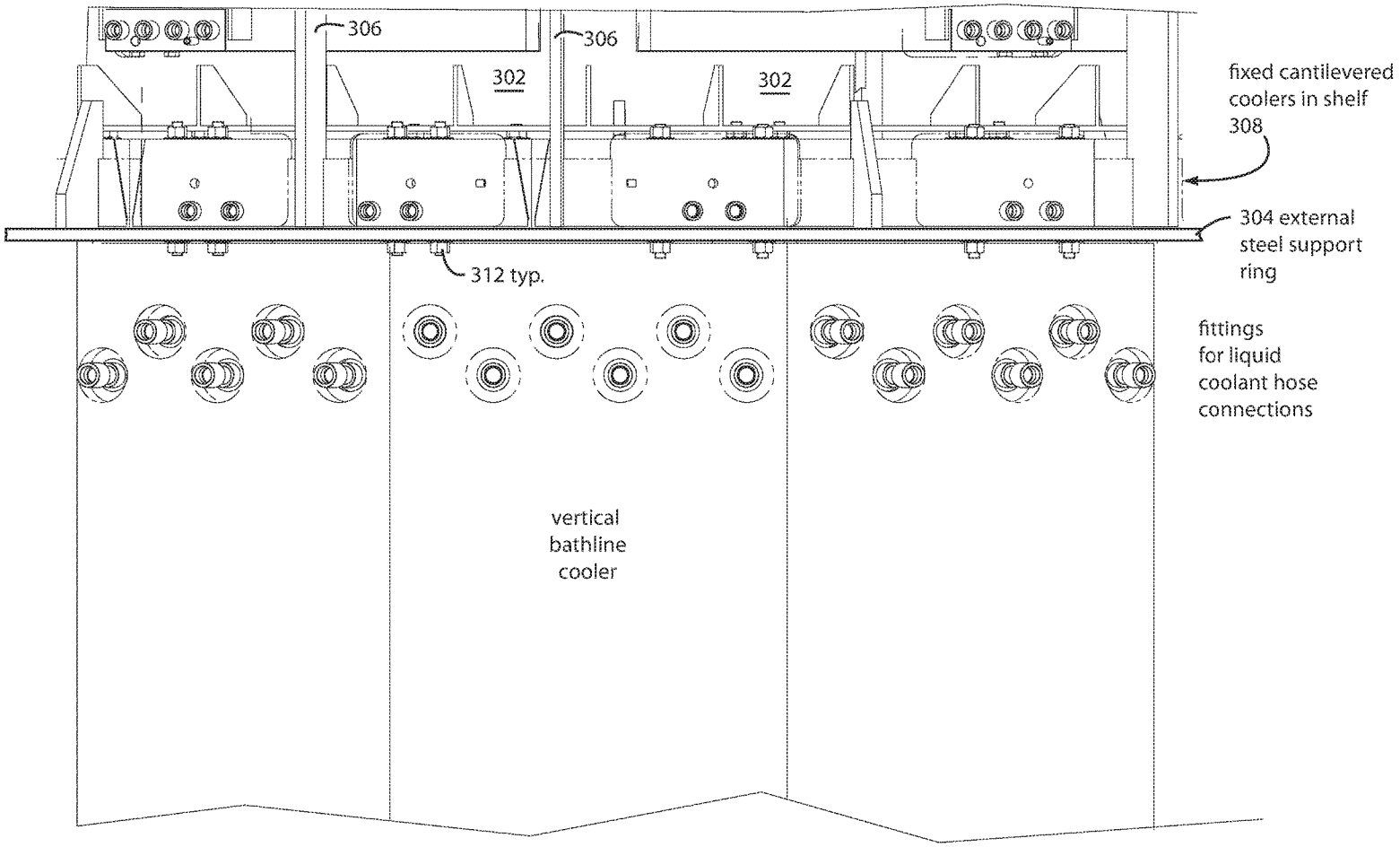
Figure 3D:
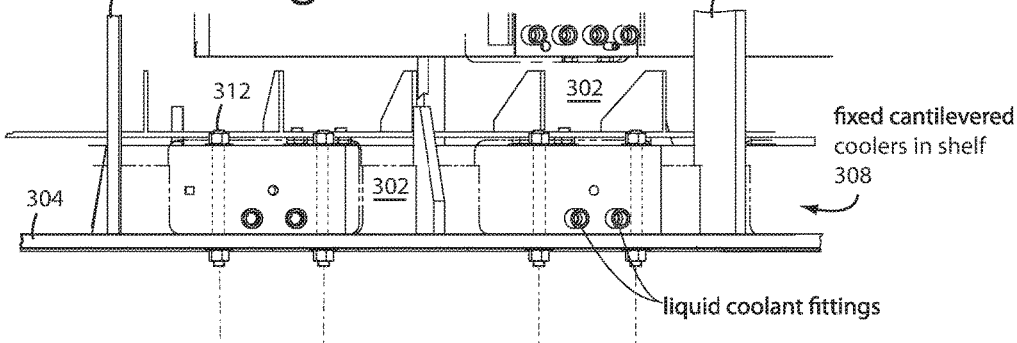
Figure 3E:
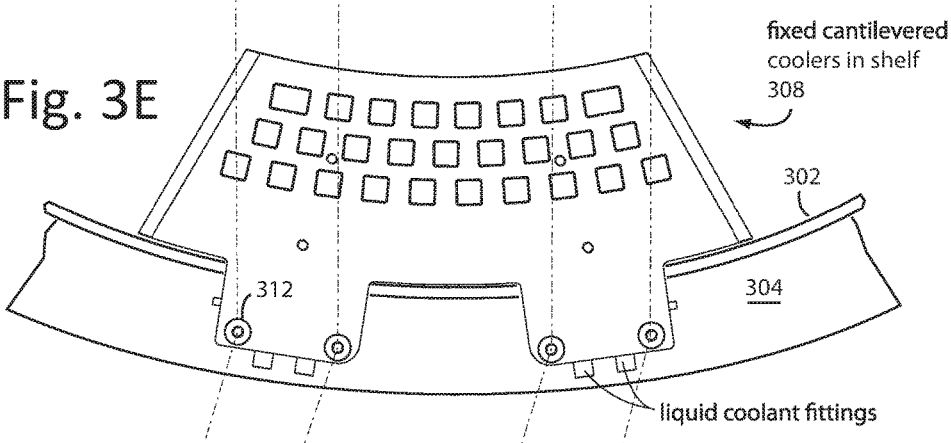
Figure 3F:
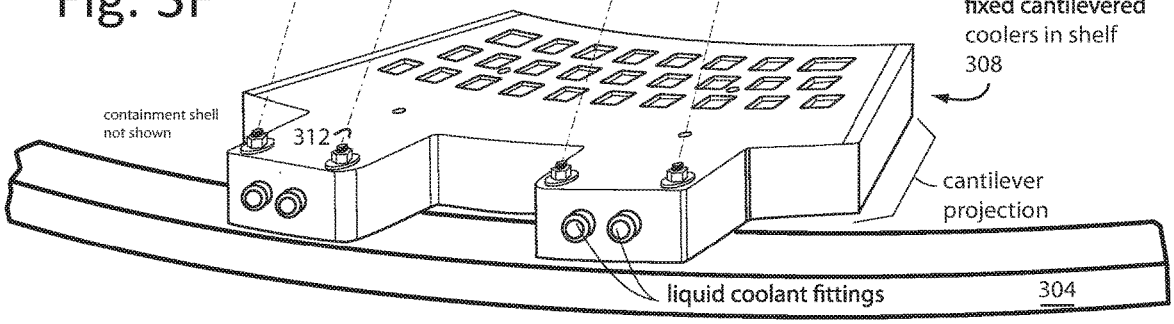

FIGS. 3A and 3B are side view diagrams of a horizontal copper cooler cantilever shelf 300 as it appears from outside a cylindrical steel vessel 302. Such is a vertically orientated metal smelting furnace embodiment of the present invention similar to that of FIGS. 1 and 2A-2C. The cylindrical steel vessel 302 is fabricated from thick plates of steel welded together into a cylinder with a rounded bottom. The cylinder is reinforced with external vertical and horizontal ribs, flanges, and gussets of plate steel. One such reinforcement is a flat steel ring 304 that functions as a horizontal rib to steel vessel 302 and a landing on which to bolt mounting foot-mounting bosses of individual cantilever copper coolers 306 and 308.

The individual cantilever copper coolers 306 and 308 do not float inside steel vessel 302. All the other vertical and horizontal copper coolers do need to float as the refractory brick they cool swells and expands over the campaign life of the furnace. Such ability to float is hinted at by the many large oversize holes that perforate the steel vessel 302 to accommodate numerous liquid coolant line connections visible in FIGS. 2A-2C and especially 3A.

FIG. 3B, in particular, shows details on how the individual cantilever copper coolers 306 and 308 can be fastened externally to horizontal rib 304. Each cantilever copper cooler 306 and 308 has a left and a ring mounting foot-mounting boss 310 and 312 that protrude through corresponding shell cutouts in steel vessel 302. A set of large machine bolts 314-317 are used here for each cantilever copper cooler 306 and 308. Such can be better understood by viewing the following illustrations.

Sometimes individual cantilever copper coolers 306 and 308 will need to be replaced. It would be a major advantage if such maintenance could be accomplished without also having to remove neighboring copper coolers or refractory brick to gain access.

FIG. 4 represents how individual cantilever copper coolers in a ring row of cantilever copper coolers 400 can be shaped using individual cantilever copper coolers 401 and 402 to render them independently and individually replaceable. The ring row of cantilever copper coolers 400 of FIG. 4 includes even numbers of cantilever copper coolers 401 and 402.

FIGS. 5A-5D represent a typical pair of matching cantilever copper coolers 501 and 502 that are used to make up the ring row of cantilever copper coolers 400 of FIG. 4. Each has a top face populated with textured pockets 504 (typ.) that help refractory castable adhere and seal out gas leaks with a refractory brick lining above. And each has a hot face that is similarly populated with textured pockets 506 (typ.) that help frozen slag and refractory castable adhere.

Figure 5B:
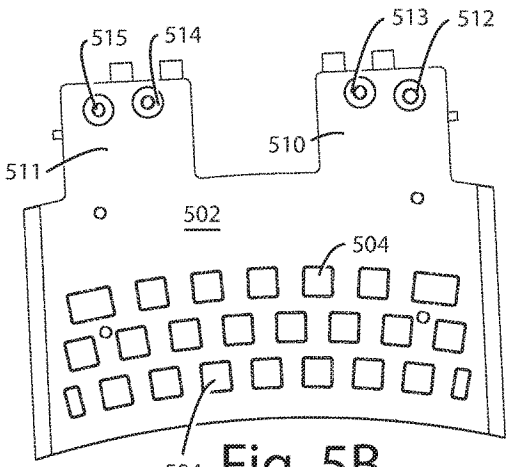
FIGS. 5A-5C are plan view diagrams of individual cantilever copper coolers that make up the ring row of cantilever copper coolers of FIG. 4.
Figure 5A:
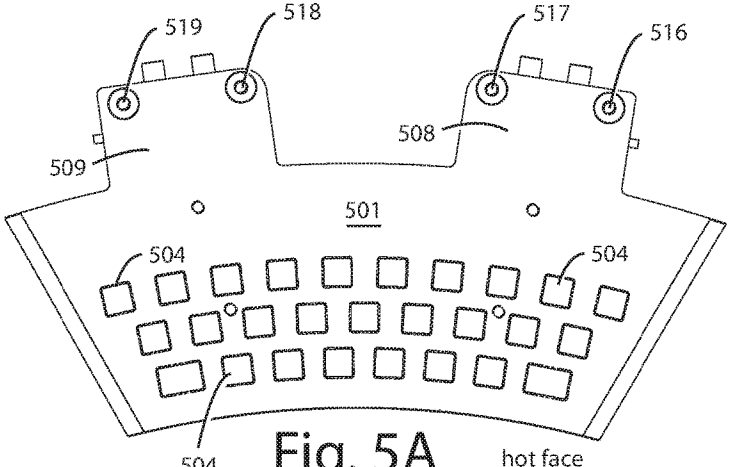
Figure 5C:
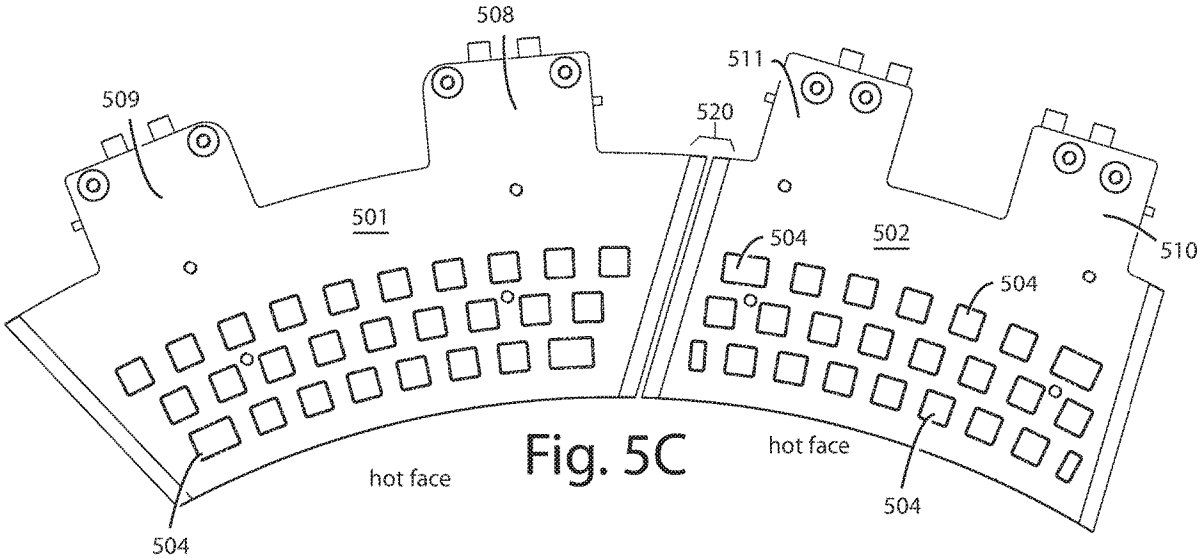
Figure 5D:
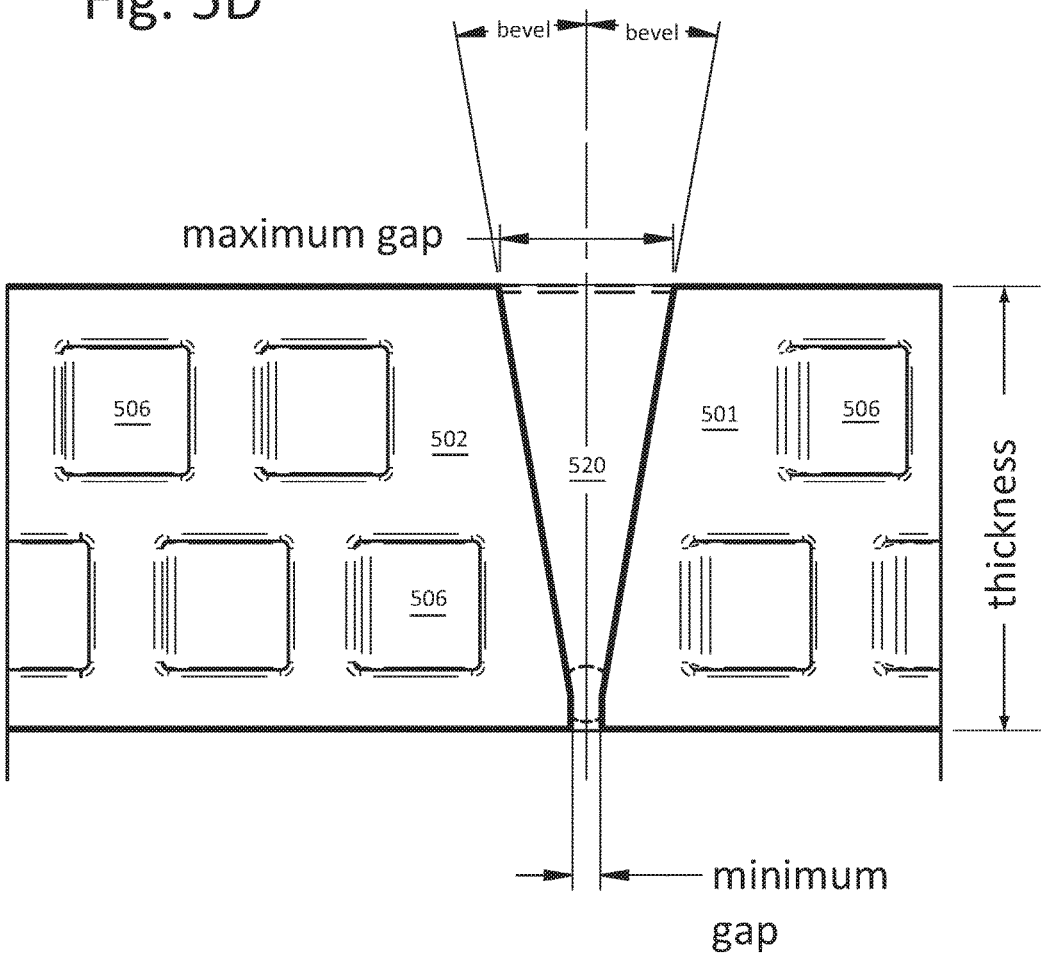
FIG. 5D is a side view diagram of the hot face of the cantilever copper coolers of FIGS. 5A-5C looking from inside a furnace. A V-slot forms between the cantilever copper coolers by beveling back the adjacent and parallel sides of each copper cooler.

FIG. 5D represents a V-slot 520 between adjacent cantilever copper coolers 501 and 502 that forms by beveling the sides of each copper cooler by about 10°. In one commercially viable embodiment of the present invention, the cantilever copper coolers 501 and 502 were 8.0" thick copper, and V-slot 520 was 0.5" minimum at the bottom and 3.1" maximum at the top. During construction or installation, a one inch diameter roll of refractory plastic or RAM is placed in the bottom of V-slot 520. Then chrome alumina castable or RAM is used to backfill V-slot 520 to within 0.12" of the top face of copper. The remainder is filled in with refractory grain to level.

Each cantilever copper cooler 501 and 502 has one or more mounting foot-mounting bosses 508-511 drilled for machine bolts 512-519.

A V-wedge of castable thus formed at each radial joint locks on top of the copper coolers, helps support the refractory brick above, and prevents any flow of hot smelting gases between the copper coolers.

FIG. 6 represents how a splash block 212 (FIG. 2A) is combined with four types of individual cantilever copper coolers in a ring 600. The shapes allow individual cantilever copper coolers to be removed and replaced in maintenance. Here we use cantilever copper coolers 601-604. Cantilever copper coolers 601 and 602 are the same as cantilever copper coolers 401 and 402 of FIG. 4. Additional cantilever copper coolers 603-604 are needed to fit square with splash block 212.

Alternative embodiments may not include this second cantilevered cantilever shelf 600, while still others may have a third and a fourth. A steel shelf may also be installed immediately above any horizontal cantilever shelf of copper coolers to provide continuing support of the refractory brick above it should there be a loss of liquid cooling.

A method embodiment of the present invention extends the campaign life of refractory brick in vertically orientated metal smelting or converting furnaces. A vertically orientated metal smelting or converting furnace vessel is partitioned into bath zone and at least one upper zone above the bath zone. The inside of the bath zone of the vessel is lined with a first lining of refractory brick such that its weight is fully supported by a floor at the bottom. A first horizontal ringed cantilever shelf of individually and independently replaceable liquid-cooled cooling elements are fastened at a fixed elevation and are mechanically fully supported by their respective attachments on the outside of the furnace vessel above the bath zone. The inside of a first upper zone of the vessel is lined with a second lining of refractory brick such that its weight is mechanically fully supported by a protruding ledge of the first horizontal cantilever shelf.

FIG. 7 represents a steel failsafe shelf support hanger 700 to keep and avert a collapse of a brick wall 702 otherwise normally supported by individual cantilevered copper coolers arranged in horizontal shelf 110. Brick wall 702 is brittle and should not move or shift if such failsafe must engage. A complete loss of cooling in the individual cantilevered copper coolers can allow the copper material to get hot enough to melt and fail as a structural support self.

The steel failsafe shelf support hanger 700 need only hold off a collapse of brick wall 702 long enough to allow the furnace to be shut down and a repair crew sent in to replace copper cooler shelf 110. The steel material used should be carbon steel to facilitate welding 704 a vertical wall part 705 to the steel containment shell 102. It can therefore be thin, perforated, vented, slotted, welded wire, etc.

A number of gussets 706 are included to keep a horizontal shelf part 708 stiff enough to assume the weight of brick wall 702 if copper cooler shelf 110 melts away.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A copper cooler for fixing inside on the walls of a furnace that is able to support the weight of a refractory-brick wall, comprising:

a liquid-cooled main body of a copper cooler that includes a cantilevered shelf top portion horizontally oriented to support and vertically transfer the weight of a refractory brick wall radially outward from inside a furnace and down into a steel containment shell;

at least one foot-mounting boss that extends the main body radially outward of the furnace through matching fenestrations in the steel containment shell for mounting; a fastening means disposed in each of the foot-mounting bosses that mounts the whole onto the steel containment shell;

wherein, all the weight of the whole copper cooler and of the refractory-brick wall supported on the cantilevered shelf top portion is transferred into the steel containment shell through the foot-mounting bosses and fastening means such that any lower refractory-brick walls beneath are relieved entirely of such weight.

2. The copper cooler of claim 1, further comprising:

at least two coolant line connectors in total disposed only through the foot-mounting bosses and connected to a liquid coolant passageway inside the main body for connection with external coolant hoses.

3. The copper cooler of claim 1, further comprising:

a failsafe steel refractory-brick wall hanger that positions between the bottom of the refractory-brick wall and the top of the cantilevered shelf top portion, and that is welded in place inside the steel containment shell, and that fully assumes the weight of refractory-brick wall in the event of a catastrophic meltdown of the main body beneath it.

4. The copper cooler of claim 1, further comprising:

a pair of shoulders that set the lateral sides of each copper cooler as parallel to one another to enable the removal and insertion of the copper cooler from inside the steel containment shell when other copper coolers are already mounted in place to each side.

5. The copper cooler of claim 1, further comprising:

a pair of shoulders that define the lateral sides of each copper cooler and each having an oppositely beveled face that assists in packing and retaining refractory to each side.

6. The copper cooler of claim 1, further comprising:

a hot face disposed on a radially inward side of the main body and including pockets, grooves, or other textures that retain material or include hardfacings to protect the hot face from wear;

wherein, any hardfacings are applied as a weld overlay of molten metal in an inert shield gas and includes any alloy between nickel and chromium that has a minimum of 55% nickel, a minimum of 18% chromium, and a maximum of 6% iron.

7. A cantilever-mounting cooler adapted to fully support an upper lining wall of refractory bricks above it and entirely relieve their weight above off of an immediately lower and continuing lining wall of refractory bricks in a smelting furnace, comprising:

a cantilever shelf cooler body of copper material having a top and a bottom surface that are generally flat and parallel to one another, and that are installed to be operated horizontally when in-service in a type of smelting furnace that is lined with an upper and a lower lining wall of refractory bricks;

wherein, the top surface is extended in a radially inwards direction of the smelting furnace to bear the entire weight of any upper lining wall of refractory bricks placed above it, and in relief of the entire weight of the upper lining wall of refractory bricks on any lower lining wall of refractory bricks immediately placed below it;

at least one foot-mounting boss that extends radially outward from the cantilever shelf cooler body and that provides the only mounting and weight supporting means of the remaining inward portion of the cantilever shelf cooler body and any upper lining wall of refractory bricks placed above it; and a liquid coolant passageway disposed inside the cantilever cooler shelf body that is coupled externally to at least two coolant line connectors;

wherein, a weakening or a collapse of the lower lining wall of refractory bricks is prevented from reducing any support of the upper lining wall of refractory bricks.

8. The cantilever-mounting cooler of claim 7, further comprising:

a coolant line connector disposed in and through any of the foot-mounting bosses, and connected to a liquid coolant passageway disposed inside the cantilever cooler shelf body.

9. The cantilever-mounting cooler of claim 7, wherein the foot-mounting bosses are configured to be passed through a matching hole cut into a steel containment shell enclosing the smelting furnace, and then be fastened to a supporting ring positioned just outside the steel containment shell and immediate to the hole cut.

10. The cantilever-mounting cooler of claim 9, further comprising:

a failsafe refractory-brick wall hanger of steel material positioned in contact with the top surface, and configured to be welded in place inside the steel containment shell, and that functions to fully assume the weight of the upper lining wall of refractory bricks in the event of a catastrophic meltdown of the cantilever shelf cooler body of copper material immediately beneath it.

* * * * *